US011143393B2

(12) United States Patent
Van Der Zanden

(10) Patent No.: US 11,143,393 B2
(45) Date of Patent: Oct. 12, 2021

(54) STACKED CIRCUIT BOARDS WITHIN A LIGHTING DEVICE

(71) Applicant: SIGNIFY HOLDING B.V., Eindhoven (NL)

(72) Inventor: Henricus Theodoras Van Der Zanden, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/057,679

(22) PCT Filed: May 21, 2019

(86) PCT No.: PCT/EP2019/063087
§ 371 (c)(1),
(2) Date: Nov. 22, 2020

(87) PCT Pub. No.: WO2019/228859
PCT Pub. Date: Dec. 5, 2019

(65) Prior Publication Data

US 2021/0199274 A1 Jul. 1, 2021

(30) Foreign Application Priority Data

May 31, 2018 (EP) ..... 18175334

(51) Int. Cl.
*F21V 23/04* (2006.01)
*H01Q 1/22* (2006.01)
(Continued)

(52) U.S. Cl.
CPC ..... *F21V 23/045* (2013.01); *F21V 23/004* (2013.01); *F21V 23/0442* (2013.01);
(Continued)

(58) Field of Classification Search
None
See application file for complete search history.

(56) References Cited

U.S. PATENT DOCUMENTS

2010/0188301 A1 7/2010 Kishimoto et al.
2013/0265779 A1* 10/2013 Scordino ..... F21V 23/006 362/368

(Continued)

FOREIGN PATENT DOCUMENTS

EP 2768074 A1 * 8/2014 ..... H01Q 1/007
EP 3132183 A1 2/2017

(Continued)

*Primary Examiner* — Alan B Cariaso
(74) *Attorney, Agent, or Firm* — Daniel J. Piotrowski

(57) ABSTRACT

A lighting device (100) is provided. The lighting device (100) includes a first circuit board (110), including at least a first light emitting element (130) and a second light emitting element (132) mounted thereon. The lighting device also includes a second circuit board (120) which comprises an aperture (140). The second circuit board is arranged relative to the first circuit board such that the aperture is positioned to match a position of the first light emitting element but not a position of the second light emitting element. The lighting device further includes a sensor and/or antenna (150), wherein at least a part of the sensor and/or antenna is provided on a portion (121) of the second circuit board which extends between the first light emitting element and the second light emitting element.

13 Claims, 5 Drawing Sheets

(51) Int. Cl.
*F21V 23/00* (2015.01)
*H01Q 1/44* (2006.01)
*F21Y 115/10* (2016.01)

(52) U.S. Cl.
CPC ..... *H01Q 1/2275* (2013.01); *H01Q 1/44* (2013.01); *F21Y 2115/10* (2016.08)

(56) References Cited

U.S. PATENT DOCUMENTS

| | | | | |
|---|---|---|---|---|
| 2014/0021862 | A1* | 1/2014 | Chung | H05B 47/19 315/112 |
| 2015/0372185 | A1* | 12/2015 | Rossi | H01L 31/0203 438/27 |
| 2016/0227636 | A1 | 8/2016 | Sun et al. | |
| 2018/0054877 | A1 | 2/2018 | Creemers et al. | |
| 2018/0101110 | A1 | 4/2018 | Tsukada | |
| 2019/0154801 | A1* | 5/2019 | Gani | G01S 7/497 |

FOREIGN PATENT DOCUMENTS

| | | | |
|---|---|---|---|
| KR | 200806294 | U | 12/2008 |
| KR | 2012007886 | A | 1/2012 |

* cited by examiner

STACKED CIRCUIT BOARDS WITHIN A LIGHTING DEVICE

CROSS-REFERENCE TO PRIOR APPLICATIONS

This application is the U.S. National Phase application under 35 U.S.C. § 371 of International Application No. PCT/EP2019/063087, filed on May 21, 2019, which claims the benefit of European Patent Application No. 18175334.4, filed on May 31, 2018. These applications are hereby incorporated by reference herein.

TECHNICAL FIELD

The present disclosure relates to the field of lighting devices. In particular, the present disclosure relates to the field of lighting devices including one or more sensors and/or antennas.

BACKGROUND

To dynamically control lighting systems, light emitting elements (such as light bulbs or light emitting diodes, LEDs) may be combined with one or more sensors. Such sensors may for example include presence detectors, which may be used to turn the light emitting elements on or off depending on whether a person is present in e.g. a particular room or area. To detect the presence of the person, presence detectors may for example use microwave radar technology, and require e.g. internal or external antennas several centimeters in size in order to match the wavelength of the transmitted (and received) radio waves.

A lighting device may include several light emitting elements mounted on a circuit board. In addition to the light emitting elements themselves, the circuit board may also include other components such as e.g. transformers, power regulators, and various passive components such as e.g. resistors, inductors and capacitors. The space remaining on the circuit board may therefore be limited, and the provision of the antenna for the presence detector may be impossible or difficult. The antenna may instead be positioned external to the lighting device, which for e.g. aesthetical reason may be less desirable. In some situations, the antenna may still be positioned within the lighting device, but at a suboptimal location in terms of technical function.

In light of the above, there is therefore a need for an improved way of providing a sensor and/or antenna in combination with a lighting device.

US 2010/188301 discloses a lamp apparatus including an optical unit and a patch antenna. The optical unit includes an LED and a substrate having the LED mounted at the front face, and a cover member having visible-light transmittance, spread over the LED at the front. In this optical unit are stored the patch antenna including a patch element and a ground element located at the rear of the patch element.

US2018/101110 discloses an image forming apparatus. A communication interface includes a communication board and a looped antenna. The communication board is arranged to be covered by a housing and has an aperture portion. The looped antenna is arranged on a circumferential edge of the aperture portion to be looped around the aperture portion. The light source includes a light source board, arranged at a position opposite to the housing across the communication interface along a direction of thickness of the communication board, and a light source mounted on the light source board.

SUMMARY

To at least partly satisfy the above needs, the present disclosure provides a lighting device as defined in the independent claim. Further embodiments of the lighting device are defined in the dependent claims.

According to an aspect of the present disclosure, a lighting device is provided. The lighting device may include a first circuit board. The first circuit board may include at least a first light emitting element and a second light emitting element mounted thereon (e.g. on a surface of the first circuit board).

The lighting device may further include a second circuit board. The second circuit board may include an aperture. The second circuit board may be arranged relative to the first circuit board such that the aperture is positioned to match a position of the first light emitting element but not a position of the second light emitting element.

The lighting device may further include a sensor and/or antenna. The sensor and/or antenna may e.g. form part of a control system for the lighting device. At least a part of the sensor and/or antenna may be provided on a portion of the second circuit board which extends between the first light emitting element and the second light emitting element. Here, the term "extending" may include also a partial extension, such as a portion of the second circuit board which may partially extend between the first light emitting element and the second light emitting element. The second circuit board may be shaped and arranged such that it, due to the aperture, does not block light emitted from the first light emitting element. The second circuit board may also be shaped and arranged such that it does not block light emitted from the second light emitting element.

Providing a second circuit board may allow for an enlarged area/space available for the sensor and/or antenna, without (due to the aperture in the second circuit board) blocking or limiting light emitted from the first light emitting element. Phrased differently, the provision of the second circuit board may allow to better utilize the area/space between the light emitting elements for positioning of the sensor and/or antenna. In some embodiments, the sensor may include the antenna. In some embodiments, only the antenna may be included. In some embodiments, both the antenna and the sensor may be included as separate components. The antenna, if included, may for example be used for the sensor, or for other purposes such as e.g. radio frequency communication (e.g. for wireless communication between multiple lighting devices and/or between a lighting device and for example a master or modem/bridge module).

In some embodiments, the second circuit board may further include a second aperture. The second circuit board may be further arranged relative to the first circuit board such that the second aperture is positioned to match a position of the second light emitting element. Providing a second aperture may allow for the second circuit board to have an even larger area/space available for the sensor and/or antenna, without blocking light emitted by the light emitting elements.

In some embodiments, the second circuit board may be arranged in physical contact with the first circuit board (e.g. directly on top of the first circuit board). Arranging the second circuit board in (direct) physical contact with the first circuit board may for example allow to reduce the dimensions of the aperture (and the second aperture, if present) while still allowing light to pass through the aperture(s). This may result in an increased area/space available for the sensor and/or antenna.

In some embodiments, the second circuit board may be arranged at a distance from the first circuit board. Depending on for example the size of the aperture, the distance may be such that light emitted by e.g. the first light emitting element may pass through the aperture (e.g. without being blocked). Arranging the second circuit board at a distance from the first circuit board may for example allow for an improved cooling of components on the first circuit board.

In some embodiments, a surface of the second circuit board facing away from the first circuit board may be flush with a surface of the first light emitting element facing away from the first circuit board. This may provide an increased transmission of light emitted by the first light emitting element through the aperture of the second circuit board. Herein, a surface of the second circuit board (or the first light emitting element) may be a surface which is opposite to a surface of the second circuit board (or the first light emitting element) which faces the first circuit board.

In some embodiments, the lighting device may include the antenna. The enlarged area/space, due to the positioning of the second circuit board on the first circuit board, may allow enough room for an antenna suitable for presence detectors operating at lower frequency (for example between 5 GHz and 15 GHz, or for example between 5 GHz and 10 GHz). Such (radar) presence detectors may be less complex and more cost efficient than detectors which may operate using smaller antennas but at increased frequencies (such as e.g. at 24 GHz or 77 GHz).

In some embodiments, the antenna may be a radar antenna and/or a radio frequency antenna. The antenna may for example be designed to operate at a frequency in the interval from 5 to 15 GHz. The antenna may for example be designed to operate in the 5 GHz and 10 GHz range.

In some embodiments, at least a part of the antenna may form at least one closed loop. The at least one closed loop may surround the aperture of the second circuit board. The closed loop may e.g. provide an improved functioning of the antenna, and the arrangement of the antenna (such that it surrounds the apertures) may allow for a further improved utilization of the available area/space on the second circuit board for the antenna. In some embodiments, the at least one closed loop may also surround more than one aperture, e.g. the second aperture (if present) of the second circuit board.

In some embodiments, the at least a part of the antenna may e.g. have a rectangular or circular shape.

In some embodiments, at least one of the first circuit board and the second circuit board may be a printed circuit board (PCB). It is envisaged also that, in some embodiments, circuit boards created using e.g. wire wrap and/or point-to-point construction may be used instead or in addition. In some embodiments, both of the first circuit board and the second circuit board may be PCBs.

In some embodiments, a material of the second circuit board may be different from a material of the first circuit board. The material of the second circuit board may for example be a material more suited for the sensor and/or antenna than the material of the first circuit board. The material of the second circuit board may for example be more expensive than the material of the first circuit board, and only using this more expensive material in the second circuit board may provide an improved cost efficiency.

In some embodiments, at least one of the first light emitting element and the second light emitting element may be a light emitting diode (LED). It is envisaged also that, in some embodiments, other light emitting elements may be used. In some embodiments, both of the first light emitting element and the second light emitting element may be LEDs. Using LEDs to produce light may be beneficial e.g. in terms of energy efficiency.

In some embodiments, the lighting device may include a tube. The tube may be transparent or translucent to light emitted by the first lighting emitting element and/or the second light emitting element. For example, the tube may be transparent or translucent to light emitted by both the first lighting element and the second light emitting element. The first circuit board and the second circuit board may be arranged within the tube. In some embodiments, the lighting device including the tube may for example be a tubular LED (TLED), wherein LEDs are used as light emitting elements and the tube is shaped like that of a tube of a fluorescent lamp. By providing the sensor and/or antenna not on the first circuit board but at the second circuit board containing the aperture, the sensor and/or antenna may be integrated into the TLED at a more optimal location (such as in the middle of the tube, instead of at e.g. an endcap of the tube or similar) while still providing transmission (i.e. non-blocking) of light emitted by the light emitting elements. This may for example also improve the functionality of the presence detector also when the TLED is mounted in a luminaire.

In some embodiments, the first light emitting element and the second light emitting element may form part of a plurality of LEDs mounted in a linear pattern on the first circuit board. A distance between neighbouring LEDs may for example be between 1 to 2 centimeters. By providing the sensor and/or antenna on the second circuit board, and by arranging the second circuit board such that the one or more apertures allow light emitted by the LEDs to pass therethrough without being blocked, the sensor and/or antenna may be provided inside (i.e. as an integrated part) of the TLED.

As described herein, the present disclosure provides arranging the second circuit board such that the space/area between two light emitting elements may be utilized for the antenna (of e.g. a presence detector), while still (due to one or more apertures of the second circuit board) allowing light emitted from light emitting elements to be transmitted without being blocked by the second circuit board.

BRIEF DESCRIPTION OF THE DRAWINGS

Exemplifying embodiments will be described below with reference to the accompanying drawings, in which.

Figure 1A:
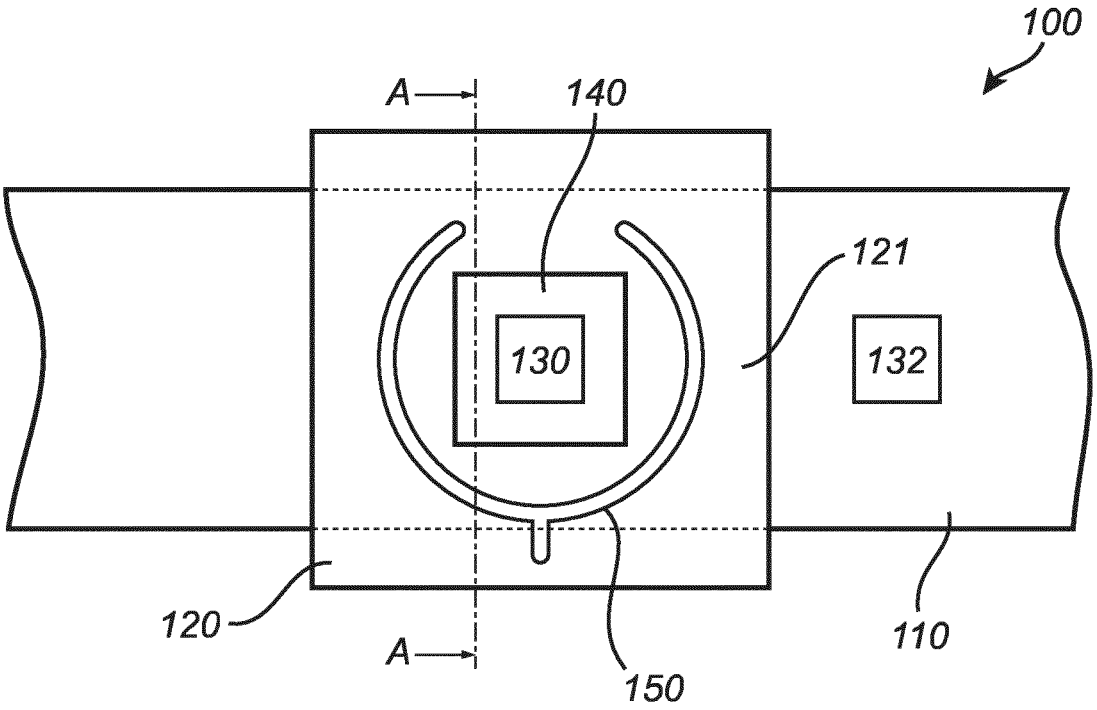
FIG. 1*a* schematically illustrates a lighting device according to embodiments of the present disclosure.

In the drawings, like reference numerals will be used for like elements unless stated otherwise. Unless explicitly stated to the contrary, the drawings show only such elements that are necessary to illustrate the example embodiments, while other elements, in the interest of clarity, may be omitted or merely suggested. As illustrated in the figures, the sizes of elements and regions may be exaggerated for illustrative purposes and, thus, are provided to illustrate the general structures of the embodiments.

DETAILED DESCRIPTION

Exemplifying embodiments will now be described more fully hereinafter with reference to the accompanying drawings. The drawings show currently preferred embodiments, but the invention may, however, be embodied in many different forms and should not be construed as limited to the embodiments set forth herein; rather, these embodiments are provided for thoroughness and completeness, and fully convey the scope of the present disclosure to the skilled person.

With reference to FIG. 1*a*, a lighting device according to an embodiment of the present disclosure is described in the following.

FIG. 1*a* schematically illustrates a lighting device 100 as seen from above. The lighting device 100 includes a first circuit board 110 and a second circuit board 120. At least a first light emitting element 130 and a second light emitting element 132 are mounted on the first circuit board 110. In the illustrated embodiment, the first and second light emitting elements 130 and 132 are LEDs. The first circuit board 110 may also include other components (not shown) such as e.g. wiring to transport electrical current to/from the first and second LEDs 130 and 132.

The second circuit board 120 is arranged above the first circuit board 110 and has an aperture 140, and is arranged relative to the first circuit board 110 such that a position of the aperture 140 matches a position of the first light emitting element (or LED) 130 but not of the second light emitting element (or LED) 132.

The lighting device 100 includes an antenna 150. At least a part of the antenna 150 is provided on a portion 121 of the second circuit board 120. The portion 121 of the second circuit board 120 extends between the first lighting element 130 and the second lighting element 132.

The first circuit board 110 may for example be a printed circuit board (PCB). The second circuit board 120 may for example also be a PCB. It is envisaged also that, in some embodiments, a material of the second circuit board 120 may for example be different from a material of the first circuit board 110, and adapted to the type of sensor (such as the antenna 150) provided on the second circuit board 120. It is envisaged also that, in some embodiments, the material of the first circuit board 110 may be the same or similar to the material of the second circuit board 120.

Figure 1B:
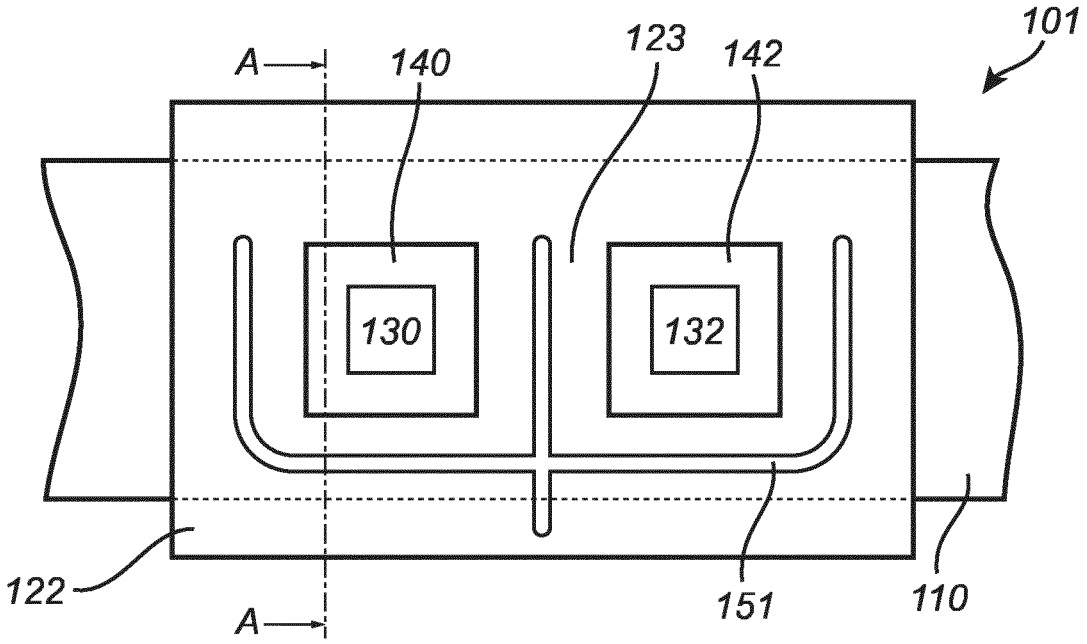
FIG. 1*b* schematically illustrates a lighting device according to embodiments of the present disclosure.

With reference to FIG. 1*b*, a lighting device according to another embodiment of the present disclosure is described in the following.

FIG. 1*b* schematically illustrates a lighting device 101 as seen from above. The lighting device 101 is similar to the lighting device 100 described with reference to FIG. 1*a*, except that the second circuit board 122 of the lighting device 101 (compared to the second circuit board 120 of the lighting device 100) also includes a second aperture 142. The second circuit board 122 is further arranged relative to the first circuit board 110 such that a position of the second aperture 142 matches a position of the second light emitting element 132. The sensor (in form of the antenna 151) is E-shaped and arranged such that at least a part of the antenna 151 is provided on a portion 123 of the second circuit board 122. The portion 123 of the second circuit board 122 extends between the first light emitting element 130 and the second light emitting element 132.

As will be described later herein, it is envisaged also that, in some embodiments, an antenna (such as the antenna 150 or 151) may have other forms, but that at least one or more parts of the sensor/antenna are provided on a portion of the second circuit board which extends between at least two light emitting elements. By utilizing the space between light emitting elements, integration of sensors/antennas several centimeters in size may be provided.

The antenna 150 may for example be a radar antenna or an antenna for radio frequency (RF) communication.

It is envisaged also that, in some embodiments, the antenna may be replaced, or complemented with, e.g. one or more sensors, which may also benefit from the increased available space/surface for their installation due to the arrangement of a second circuit board on a first circuit board.

Figure 1C:
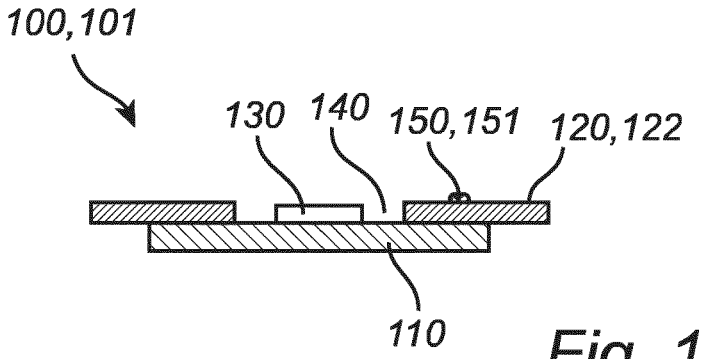
FIG. 1*c* schematically illustrates a cross-section of the lighting device in FIG. 1*a* or 1*b;*
Figure 1D:
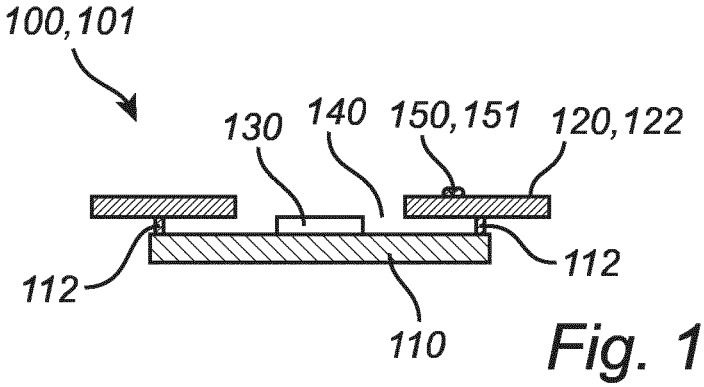
FIG. 1*d* schematically illustrates a cross-section of the lighting device in FIG. 1*a* or 1*b;*

FIGS. 1*c* and 1*d* illustrate schematically the lighting devices 100 and 101 as seen from the side, towards the cutting plane A-A (as indicated in the respective FIGS. 1*a* and 1*b*).

In FIG. 1*c*, the second circuit board 120 or 122 is arranged in physical contact with (i.e. directly above, or on top of) the first circuit board 110. This may provide e.g. an optimal transmission (i.e. minimal blocking) of light emitted by e.g. the first light emitting element 130 through the aperture 140. The surfaces of the second circuit board 120 or 122 and the light emitting element 130 which face away from the surface of the first circuit board 110 (i.e. the surfaces opposite to the surfaces of the second circuit board 120 or 122 and the light emitting element 130 which face towards the first circuit board 110) are flush. Phrased differently, the light emitting element 130 is not below the top surface of the second circuit board 120 or 122. This may provide a further improvement in light transmission through the aperture 140. It may be envisaged also, in some embodiments, that the top surface of the second circuit board 120 or 122 is slightly above the top surface of the light emitting element 130, but not enough to affect the transmission of light through the aperture 140 of the second circuit board 120 or 122.

In FIG. 1*d*, the second circuit board 120 or 122 is arranged at a distance from the first circuit board 110, using e.g. on or more spacer elements 112. Although the top surface of the second circuit board 120 or 122 is no longer flush with the top surface of the light emitting element 130, the distance is still small enough not to block the light emitted from the light emitting element 130. In the embodiment of the lighting device 100 or 101 illustrated in FIG. 1*d*, it may also be envisaged that the second circuit board 120 or 122 is still arranged at a distance from the first circuit board 110, but that the thickness of the second circuit board 120 or 122 is such that the top surfaces are still flush.

Figure 2A:
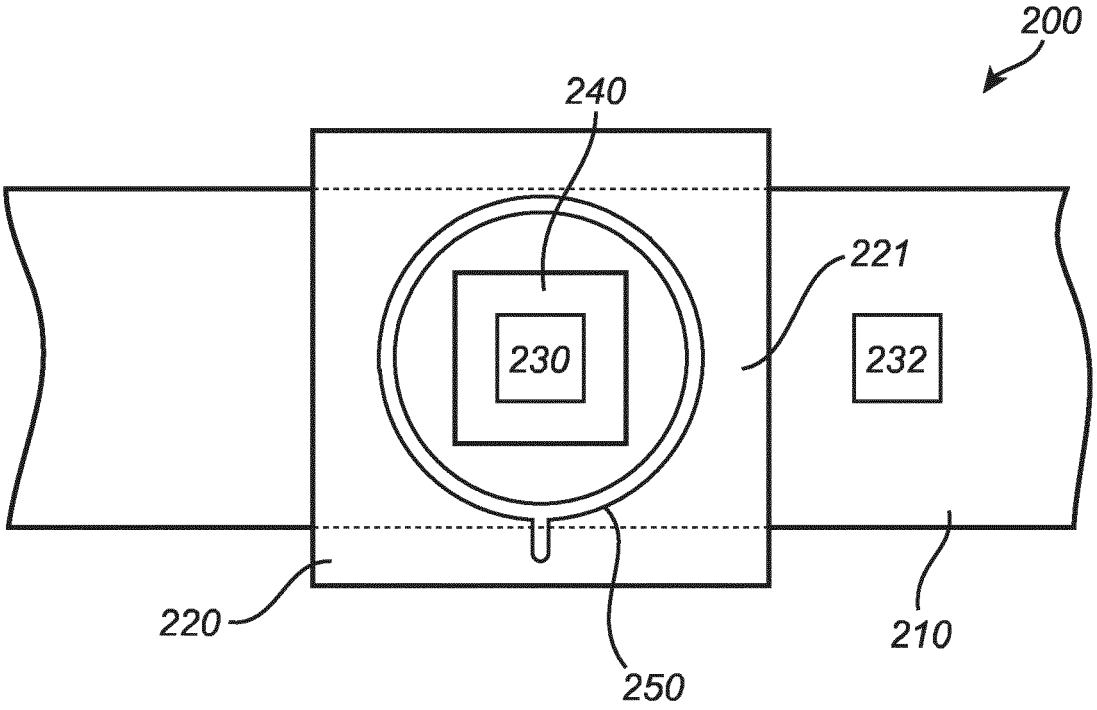
FIG. 2*a* schematically illustrates a lighting device according to embodiments of the present disclosure.
Figure 2B:
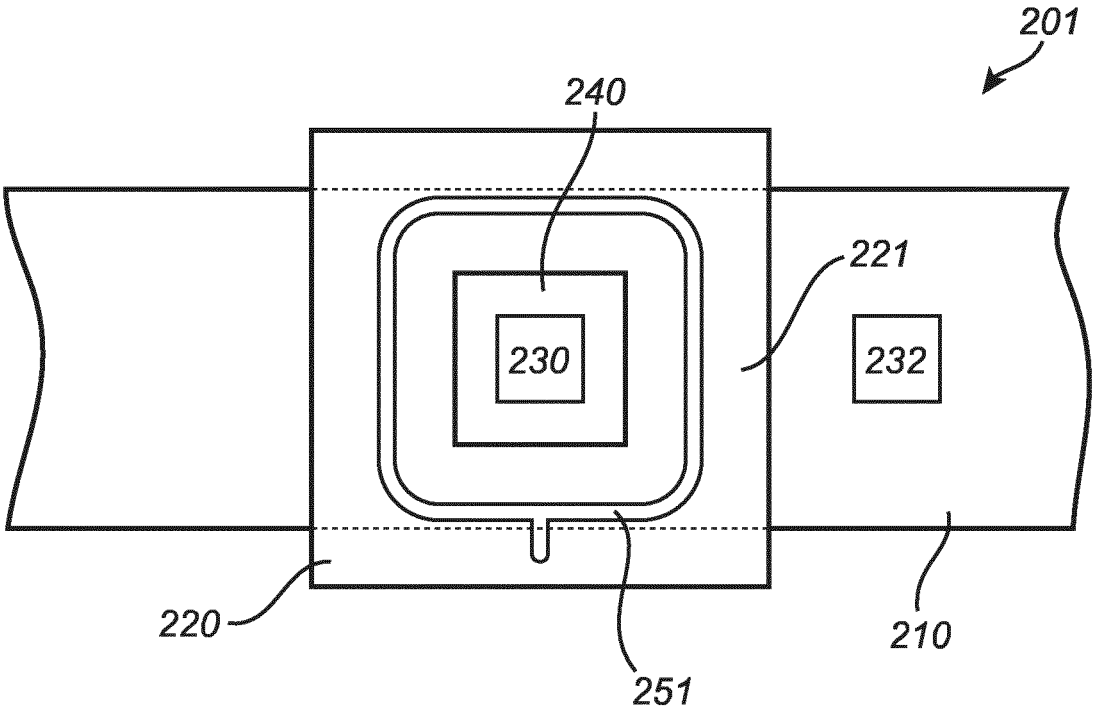
FIG. 2*b* schematically illustrates a lighting device according to embodiments of the present disclosure.

With reference to FIGS. 2*a*, 2*b* and 2*c*, further embodiments of lighting devices according to the present disclosure will be described below.

FIGS. 2*a* and 2*b* illustrate schematically embodiments of respective lighting devices 200 and 201, wherein the respective antennas 250 and 251 have different shapes.

In FIG. 2*a*, the antenna 250 includes a closed loop and is arranged on the second circuit board 220 such that it surrounds the aperture 240. The antenna 250 has a circular shape.

In FIG. 2*b*, the antenna 251 also includes a closed loop, and the antenna 251 is also arranged on the second circuit board 220 such that it surrounds the aperture 240. The antenna 251 has a rectangular shape.

In both of the embodiments of the lighting devices 200 and 201, at least parts of the antennas 250 and 251 are provided on portions 221 of the second circuit boards 220 which extend between the first light emitting element 230 and the second light emitting element 232.

Figure 3A:
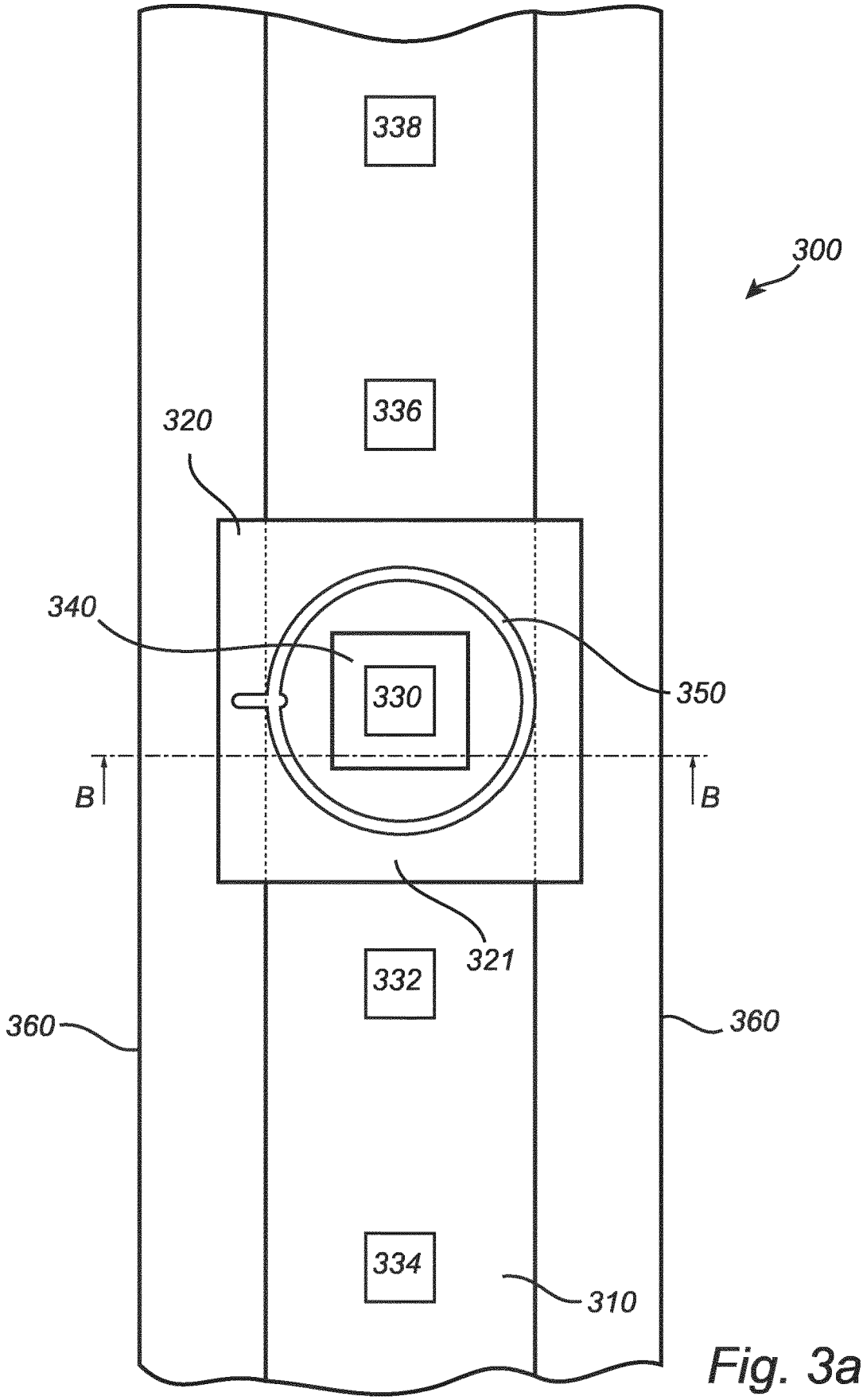
FIG. 3*a* schematically illustrates a lighting device according to embodiments of the present disclosure, and FIG. 3*b* schematically illustrates a cross-section of the lighting device in FIG. 3*a*.
Figure 3B:
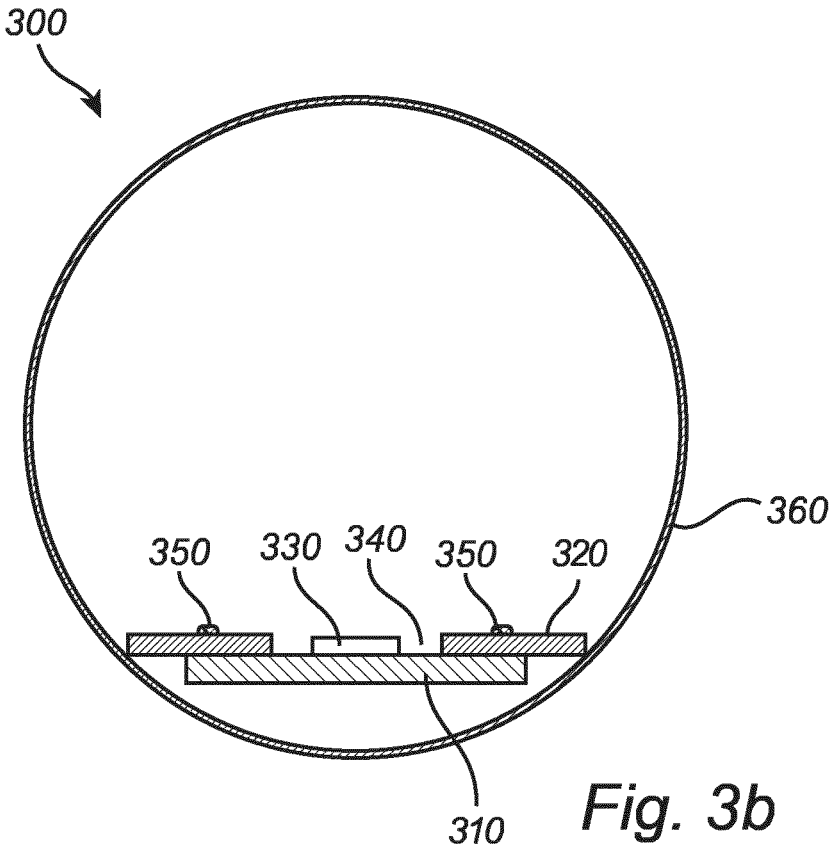

With reference to FIGS. 3*a* and 3*b*, an embodiment of a lighting device in the form of a tubular LED (TLED) will be described in the following.

FIG. 3*a* illustrates schematically a lighting device 300 as seen from above. The lighting device 300 includes a tube 360 which is transparent or translucent to light emitted from a plurality of light emitting elements of the lighting device 300. In FIG. 3*a*, five such light emitting elements are illustrated as LEDs 330, 332, 334, 336 and 338. The LEDs 330-338 are arranged/mounted in a linear pattern on a first circuit board (PCB) 310 of the lighting device 300. The lighting device 300 may for example be a TLED.

The lighting device 300 also includes a second circuit board 320 which is arranged above the first circuit board 310. The second circuit board 320 includes an aperture 340 which is positioned to match a position of a first light emitting element (LED) 330. The size and shape of the aperture 340 is such that light emitted by the first light emitting element 330 may escape through the aperture 340 without being blocked. It is envisaged that the second circuit board 320 may, for this reason, for example be arranged directly on top of (e.g. in physical contact with) the first circuit board 310.

The second circuit board 320 extends between the first light emitting element 330 and a second light emitting element 332. The aperture 340 is positioned such that its position does not match the position of the second light emitting element 332, i.e. such that a portion 321 of the second circuit board 320 between the first and second light emitting elements 330 and 332 may be utilized as a space/area in which a sensor and/or antenna may be installed/provided.

Provided on the portion 321, the lighting device 300 includes an antenna 350. In the embodiment of the lighting device 300 as illustrated in FIG. 3*a*, the antenna 350 has a circular shape and includes a loop which surrounds the aperture 340. As described herein, it may be envisaged also that, in some embodiments, the antenna 350 has other shapes which may also fit due to utilization of the additional space/area provided by the portion 321 of the second circuit board 320 extending between light emitting elements. It is, in addition, envisaged also that the second circuit board 320 may, in some embodiments, include more than one aperture, and that the positions of these additional apertures may match those of other light emitting elements than the LED 330. For example, the second circuit board 320 may include a second aperture, and the second circuit board 320 may be arranged such that the position of the second aperture (not shown) matches that of the second light emitting element (LED) 332.

FIG. 3*b* illustrates schematically a view of the lighting device 300 as seen from the side, towards the cutting plane B-B indicated in FIG. 3*a*.

The first circuit board 310 and the second circuit board 320 are arranged within the tube 360. The second circuit board 320 is arranged on top of the first circuit board 310, and the arrangement of the first and second circuit boards 310 and 320 within the tube 360 allows, as described earlier herein, to position e.g. the sensor (antenna 350) at a more optimal location within the tube 360.

As described earlier herein, in some embodiments, the antenna 350 may be replaced by, or complemented with, e.g. one or more sensors which may benefit from the additional area/space made available by the arrangement of the second circuit board 320 on the first circuit board 310.

By providing a sensor and/or antenna on a second circuit board which may be arranged on top of a first circuit board and provided with one or more apertures through which light emitted by light emitting elements (e.g. LEDs) mounted on the first circuit board may pass without being blocked, the present disclosure allows to utilize the space/area available between the light emitting elements more efficiently. This may allow for sensors/antennas which would normally not fit on the first circuit board to be used and included within the lighting device. As an example, as provided herein, this may allow to provide a tubular LED (TLED) having an antenna which is located more optimally (e.g. towards the middle of the tube), instead of placing the antenna towards (or in) an endcap of the tube, or as an external antenna. In addition to technical and/or aesthetical reasons, this may also allow to use antennas suitable for presence detectors operating at lower frequencies, thereby reducing the cost of such detectors and the cost and/or complexity of the lighting device itself.

Although features and elements are described above in particular combinations, each feature or element may be used alone without the other features and elements or in various combinations with or without other features and elements.

Additionally, variations to the disclosed embodiments can be understood and effected by the skilled person in practicing the claimed invention, from a study of the drawings, the disclosure, and the appended claims. In the claims, the word "comprising" does not exclude other elements, and the indefinite article "a" or "an" does not exclude a plurality. The mere fact that certain features are recited in mutually different dependent claims does not indicate that a combination of these features cannot be used to advantage.

The invention claimed is:

1. A lighting device, comprising:

a first circuit board, comprising at least a first light emitting element and a second light emitting element mounted thereon;

a second circuit board comprising an aperture, and being arranged relative to the first circuit board such that the aperture is positioned to match a position of the first light emitting element but not a position of the second light emitting element; and a sensor and/or antenna, wherein at least a part of said sensor and/or antenna is provided on a portion of the second circuit board extending between the first light emitting element and the second light emitting element, and wherein a surface of the second circuit board facing away from the first circuit board is flush with a surface of the first light emitting element facing away from the first circuit board.

2. The lighting device of claim 1, wherein the second circuit board further comprises a second aperture, wherein the second circuit board is further arranged relative to the first circuit board such that second aperture is positioned to match a position of the second light emitting element.

3. The lighting device of claim 1, wherein the second circuit board is arranged in physical contact with the first circuit board.

4. The lighting device of claim 1, wherein the second circuit board is arranged at a distance from the first circuit board.

5. The lighting device of claim 1, wherein the lighting device includes the antenna.

6. The lighting device of claim 5, wherein the antenna is a radar antenna and/or a radio frequency antenna.

7. The lighting device of claim 5, wherein at least a part of the antenna forms at least one closed loop surrounding the aperture of the second circuit board.

8. The lighting device of claim 7, wherein said at least a part of the antenna has a rectangular or circular shape.

9. The lighting device of claim 1, wherein at least one of the first circuit board and the second circuit board is a printed circuit board, PCB.

10. The lighting device of claim 1, wherein a material of the second circuit board is different from a material of the first circuit board.

11. The lighting device of claim 1, wherein at least one of the first light emitting element and the second light emitting element is a light emitting diode, LED.

12. The lighting device of claim 1, wherein said lighting device comprises a tube which is transparent or translucent to light emitted by the first light emitting element and the second light emitting element, and wherein the first circuit board and the second circuit board are arranged within said tube.

13. The lighting device of claim 12, wherein the first light emitting element and the second light emitting element form part of a plurality of light emitting diodes, LEDs, mounted in a linear pattern on the first circuit board.

* * * * *